US006931771B1

(12) United States Patent
Liebl

(10) Patent No.: US 6,931,771 B1
(45) Date of Patent: Aug. 23, 2005

(54) FOLD-DOWN CHUTE FOR SNOW BLOWER

(75) Inventor: John G. Liebl, Atwater, MN (US)

(73) Assignee: Clark Equipment Company, Woodcliff Lake, NJ (US)

( * ) Notice: Subject to any disclaimer, the term of this patent is extended or adjusted under 35 U.S.C. 154(b) by 9 days.

(21) Appl. No.: 10/612,735

(22) Filed: Jul. 2, 2003

(51) Int. Cl.[7] ..... E01H 5/04
(52) U.S. Cl. ..... 37/260; 37/262; 37/248
(58) Field of Search ..... 37/260, 261, 262, 37/248

(56) References Cited

U.S. PATENT DOCUMENTS

| | | | | | |
|---|---|---|---|---|---|
| 1,031,472 | A | | 7/1912 | Schubert | |
| 1,816,589 | A | * | 7/1931 | Johnson | 37/256 |
| 2,198,237 | A | * | 4/1940 | Voorderman | 37/258 |
| 2,223,372 | A | * | 12/1940 | Klauer | 37/261 |
| 2,390,421 | A | * | 12/1945 | Cadwell | 37/256 |
| 2,408,857 | A | * | 10/1946 | James | 37/240 |
| 2,642,680 | A | | 6/1953 | Curtis | 37/43 |
| 3,075,813 | A | | 1/1963 | Vohl | 302/61 |
| 3,088,779 | A | * | 5/1963 | Vachon | 406/158 |
| 3,583,084 | A | | 6/1971 | Farrell | 37/43 E |
| 3,624,931 | A | | 12/1971 | Wandscheer et al. | 37/43 F |
| 3,698,576 | A | * | 10/1972 | Gillette | 414/301 |
| 4,184,274 | A | | 1/1980 | Vohl | 37/43 R |
| 4,312,143 | A | * | 1/1982 | Kado | 37/261 |
| 4,314,610 | A | | 2/1982 | Riewerts et al. | 172/776 |
| 4,549,365 | A | | 10/1985 | Johnson | 37/251 |
| 4,651,452 | A | | 3/1987 | Husso | 37/225 |
| 4,862,607 | A | | 9/1989 | Wacker | 37/260 |

* cited by examiner

*Primary Examiner*—Robert E. Pezzuto
*Assistant Examiner*—Thomas A Beach
(74) *Attorney, Agent, or Firm*—Westman, Champlin & Kelly, P.A.

(57) ABSTRACT

A snow blower attachment for a skid steer loader has a tall discharge chute used for loading high vehicles such as trucks. The discharge chute is folded in the center, and has a strut to support it in its working position. The strut is releasable for folding the chute, and has a saddle that rests on the snow blower housing so that the folded upper chute section is supported adequately during storage.

7 Claims, 4 Drawing Sheets

60
64
62
70
42
68
72
44B
38
56
88
90
44A
50
46
66
55
34
40
54
12
74
76
16
44
22
24
14
18
20
36
10
26
11
48

FOLD-DOWN CHUTE FOR SNOW BLOWER

BACKGROUND OF THE INVENTION

The present invention relates to a folding discharge chute for a rotary snow blower attachment for various prime movers, for example, a skid steer loader. The snow blower includes a feed auger, and an impeller that will project snow upwardly through a chute to a high loading level. The chute includes an upper section that is held in place during use, and when in storage, is folded so that the upper end of the upper section points downwardly from its hinged point and is supported on an upper edge of the snow blower housing.

Various rotary snow blowers have been advanced in the past. These include attachments that go on the front end of skid steer loaders, and which have feed augers that will engage the snow and move it in toward a central impeller that discharges the snow upwardly through an output chute. For example, U.S. Pat. No. 3,075,813 shows a snow blower that has a chute that is adjustable for adjusting the positions of the discharge.

U.S. Pat. No. 3,583,084 also shows a conventional rotary snow blower, which has a discharge chute that includes an upper end that is adjustable for directing the snow in a particular path.

U.S. Pat. No. 4,651,452 discloses an apparatus for snow removal that has a discharge chute that is hinged in the center, so that it can be folded down. It is a laterally extending chute, and when folded, projects laterally from the housing a substantial amount. In addition, it is not supported on the housing when folded. The folding section is operated with a hydraulic actuator, but the specification does mention that a fixed support can be used in place of the hydraulic actuator.

Bobcat Company, a business unit of Ingersoll-Rand Company, of Gwinner, N.Dak., has sold a snow blower attachment for its skid steer loaders for several years.

The need for high discharge chutes has increased, particularly where snow is to be loaded into a truck, and moving it from place to place can be a problem with low clearance overhead structures. Also, storing the snow blower attachment during the summer time and when not in use means that the tall chutes have to be accommodated in some manner. The present invention relates to a folding chute that has an upper section that will fold down to reduce the overall height of the snow blower attachment, and thus make transport and storage easier.

SUMMARY OF THE INVENTION

The present invention relates to a snow blower having a high discharge chute that can be used for loading snow into trucks, as it is removed or plowed off a street, and which has a folding upper section to reduce the overall height of the chute. The chute has an adjustable deflector at the upper end, which can adjust the path of the snow being discharged from the impeller.

The chute is mounted so that it will rotate about a vertical axis, in order to discharge the snow to the side of the attachment and the prime mover that mounts the attachment. The chute is made in two sections, including a base section mounted onto the snow blower housing, and an upper section that is hinged to the lower section about a transverse or horizontal pivot axis.

The upper section of the snow blower chute is held in its working position with a strut that pivoted on the upper chute section, and is fixed in place on the base or lower chute section during use. The strut can be released and used manually for lowering the outer end of the upper snow blower chute section about its horizontal pivot. The strut has a bracket that will rest on the top of the auger housing for the snow blower attachment and support the upper section in folded or lowered position.

Additionally, springs are provided between the two chute sections adjacent the pivot between the sections. The spring force goes over center and exert a force tending to hold the upper chute in working position when it is raised, and as the upper chute section lowers, the spring force line moves across the horizontal pivot axis and provides a force urging the outer end of the upper chute section toward the snow blower housing. This force urges the folded section toward the auger housing and maintains the upper section bracket supported on the upper edge of the housing, when the upper chute section is folded.

When the upper chute section is to be raised, the strut is used as a manual prop to help in pivoting the chute section upwardly. Again, as the upper chute section moves about its pivot to the working position, the spring force goes over center and aids in raising the upper chute section to its working position where it can be supported with a strut onto a suitable bracket.

The folding chute is easily used, and greatly aids in the transporting and storage of the snow blower attachment when it is removed from a prime mover, such as a skid steer loader.

DETAILED DESCRIPTION OF THE ILLUSTRATIVE EMBODIMENTS

Figure 1:
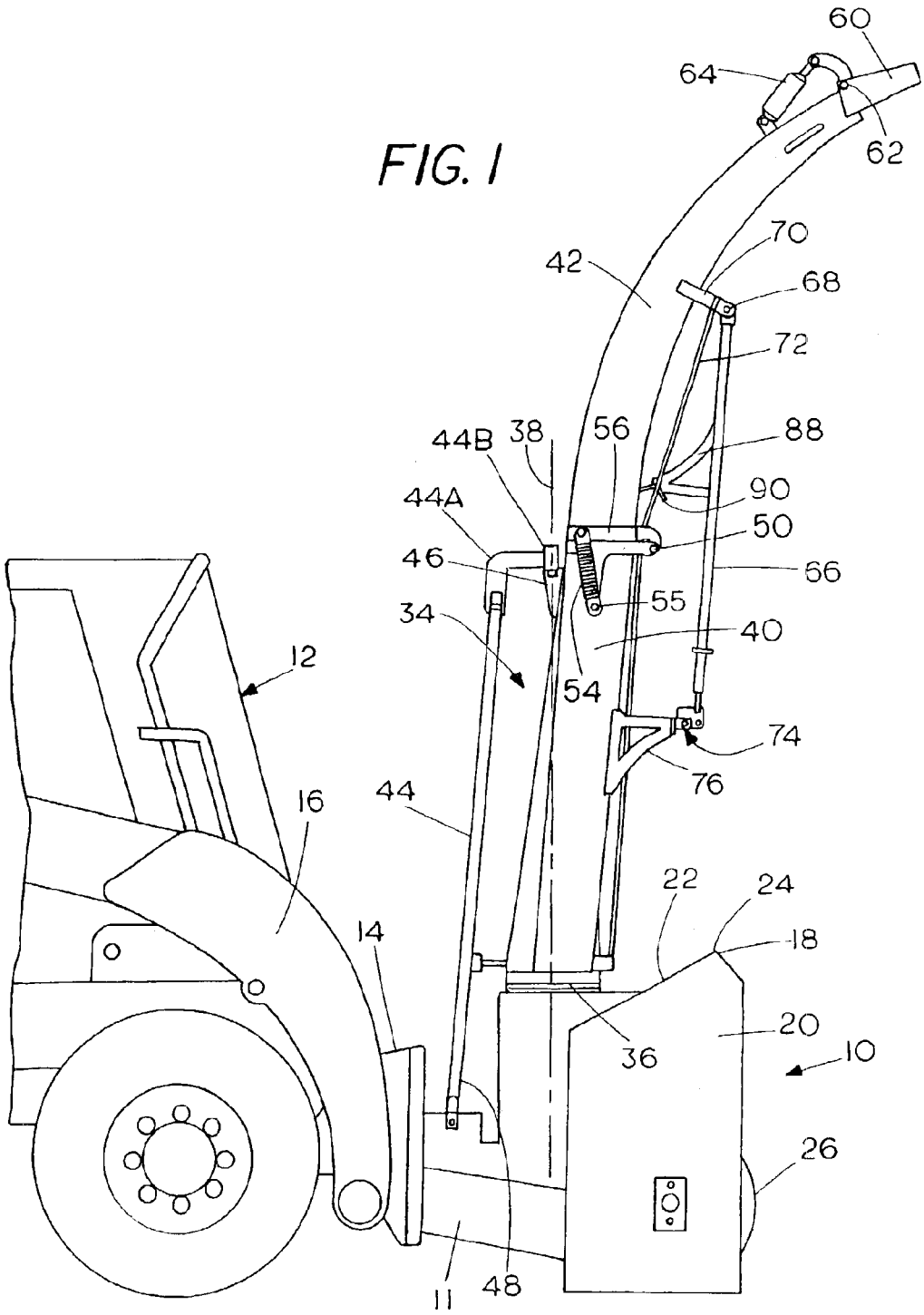
FIG. 1 is a side elevational view of a snow blower having a folding discharge, chute made according to the present invention and installed on a skid steer loader.

Referring to FIG. 1, a rotary snow blower indicated generally at 10 is formed as an attachment to a skid steer loader 12. The skid steer loader 12 has a conventional attachment plate 14 at the forward ends of lift arm 16, on which a mounting frame 11 for the snow blower attachment 10 is mounted. The snow blower attachment has an auger housing or frame 18, which includes rear frame supports 11 that attach to the attachment plate 14.

Figure 5:
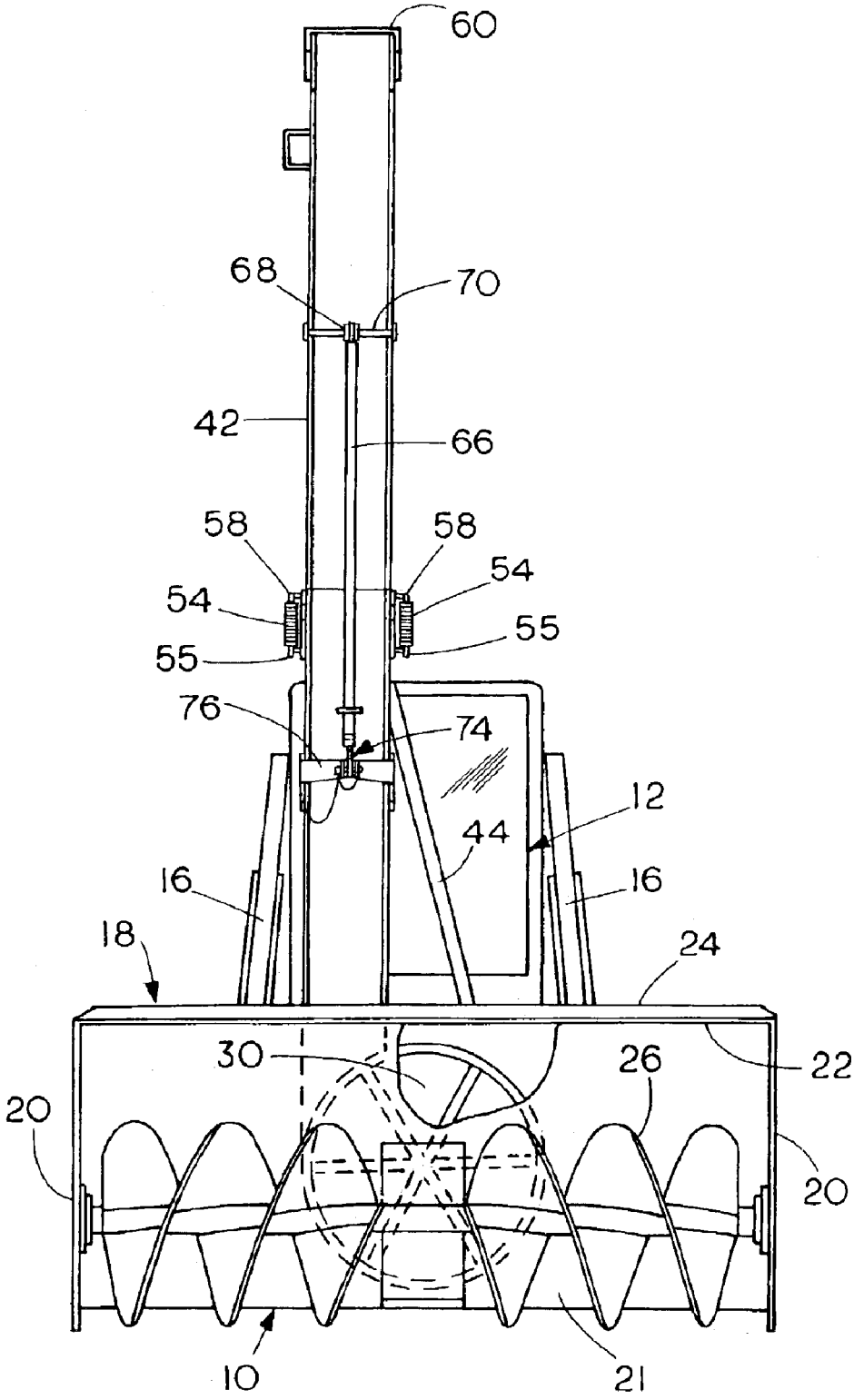
FIG. 5 is a front elevational view of the device of FIG. 1.

As shown in FIG. 5, as well as in FIG. 1, the snow blower attachment auger housing has spaced side plates 20, and walls 21 between the side plates, to form the housing 18. The walls 21 include a top wall 22 that is rigid and has a ridge 24 at its upper and forward edge. The snow blower 10 has an auger or rotor at its forward end indicated generally at 26. The rotor is mounted between and on the side plates 20. The rotor is rotated through the use of a hydraulic motor illustrated only schematically at 28 in FIG. 2.

The motor 28 drives the shaft mounting the auger 26, and a separate hydraulic motor (not shown) drives an impeller or rotor shown in FIG. 5 fragmentarily at 30. The rotor 30 is mounted in a rotor housing 32 and positioned at the back of the auger housing 18. The impeller 30 is a conventional rotating fan type wheel unit that will receive snow from the auger 26, and will drive the snow upwardly through a discharge chute 34.

The discharge chute 34 is mounted to the impeller housing on a swivel 36, and as can be seen, the chute 34 can be rotated about an upright axis 38. The chute 34 is divided into two sections in the present invention, and including a lower or base chute section 40, and a foldable upper chute section 42. The lower chute section 40 is mounted with the swivel so it can be rotated, and is braced back to the frame 11 mounting for the snow blower attachment with a wishbone brace structure 44. The brace 44 has a forwardly projecting portion 44 A that has a hub 44B to pivotally support a pivot pin on a bracket 46 at the upper, end of the lower chute section 40. The hub and pivot pin permit pivoting of the chute. The brace 44 has lower end 48 fastened back onto the frame 11.

Figure 2:
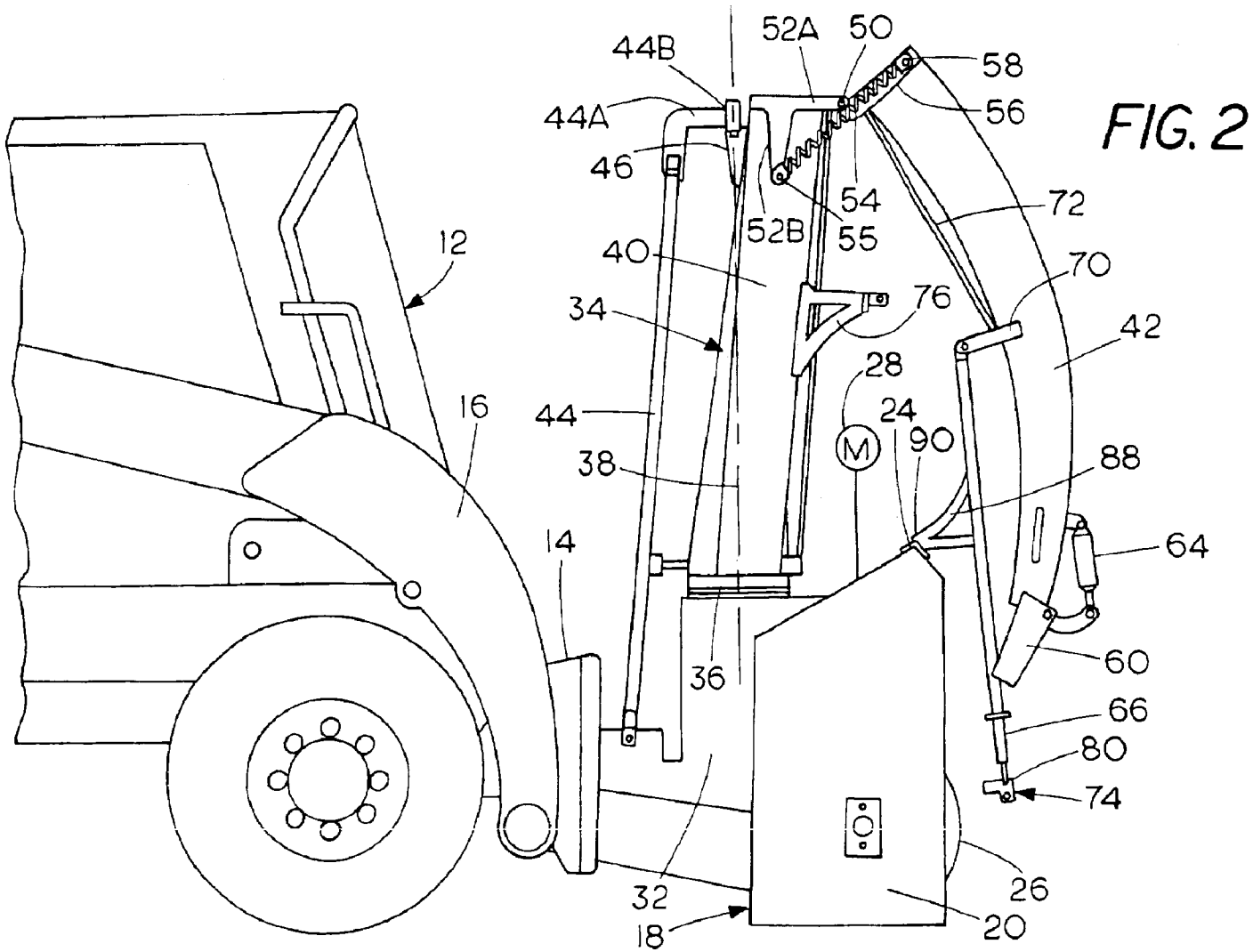
FIG. 2 is a side elevational view of the device of FIG. 1 with the discharged chute in a folded storage position.
Figure 3:
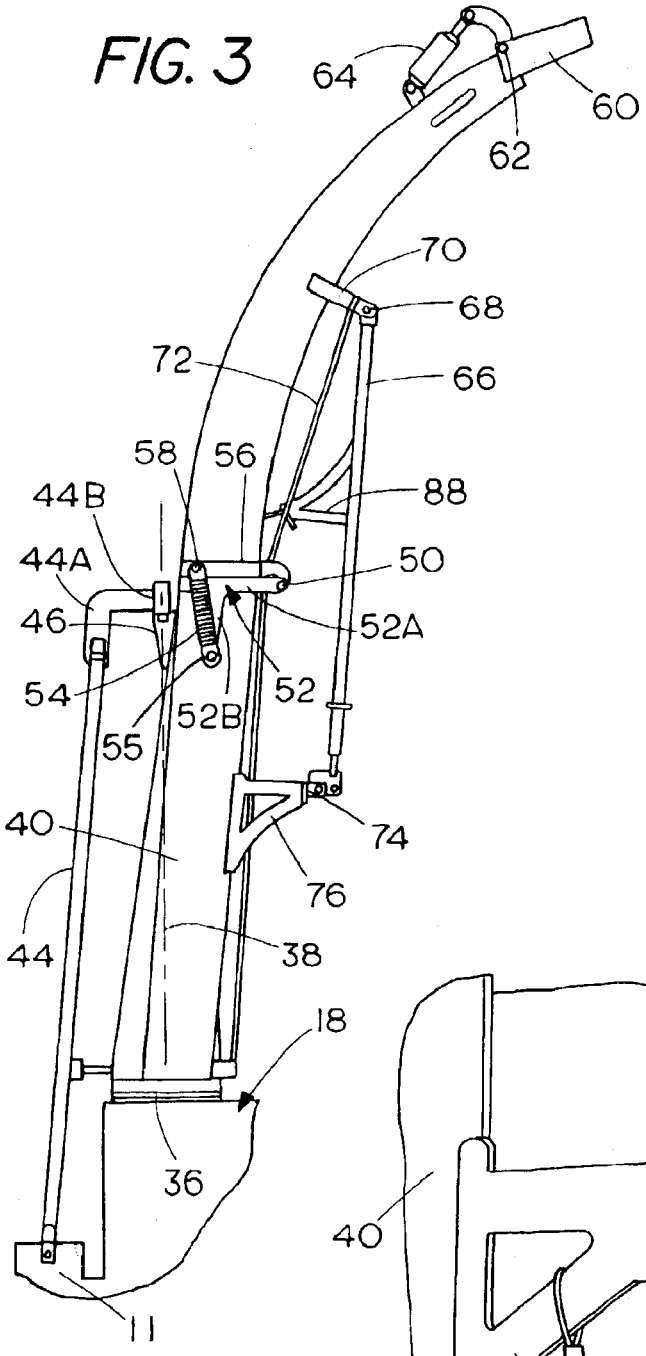
FIG. 3 is a side elevational view of the folding discharge chute of the present invention in its working position.

The upper chute section 42 is pivoted to the lower chute section 40 with a pivot pin 50 that connects brackets on the two chute sections. As can be seen in FIGS. 2 and 3, the lower chute section 40 has a bracket 52 fixed to an upper end thereof that has a first leg 52A that projects forwardly to support the pivot pin 50. The bracket 52 also has a depending leg 52B that is used for anchoring a pair of tension springs 54 (one on each side of the chute) at connections 55.

The upper chute section 42 has a mating bracket 56 at its lower end, and it includes a portion that receives the pivot pin 50 so it is pivotally mounted. The bracket 56 also extends rearwardly when the upper section is in working position, as shown in FIG. 3, to mount second ends of springs 54 at 58 to the bracket 56.

Upper chute section 42 has a deflector 60 at its upper outlet end that is pivotally mounted about an axis 62 and is controlled as to its angle with a hydraulic actuator 64 in a conventional manner. Actuator 64 is a double-acting hydraulic actuator operated by the hydraulic system of the prime mover on which the snow blower attachment is mounted.

Upper discharge, chute section 42 is supported in its working position with a strut 66, that is attached at a pivot 68 to a bracket 70 on the mid-portions of the upper chute section 42. The bracket 70 is braced back to the bracket 56 with a load carrying link 72. The strut 66 has its lower end connected to a bracket 74 that is supported with a support bracket 76 back to the lower section 40 of the chute. The bracket 74 is shown in greater detail in FIG. 4. It can be seen that the strut 66 has a threaded adjustment screw 78 at its lower end that is attached to a plate 80 that fits between side plates forming the bracket 74.

A removable pin 82 is used for fastening the plate 80 to support bracket 76, and as can be seen, it has a cable 84 that keeps it close to the brackets when the pin is removed. Thus, the strut 66 can be removed from the bracket 76 easily, merely by taking the pin 82 out of the connection.

The strut 66 has a rest bracket 88 fixed thereto. The rest bracket 88 has a saddle 90 positioned so that when the strut 66 is folded to its storage position as shown in FIG. 2, the saddle 90 rests on the front edge ridge 24 of the snow blower auger housing.

It can be seen in the folded position, that the upper chute section tilts downwardly. The strut, end bracket plate 80 is unattached, and is positioned in front of the snow blower housing.

Figure 4:
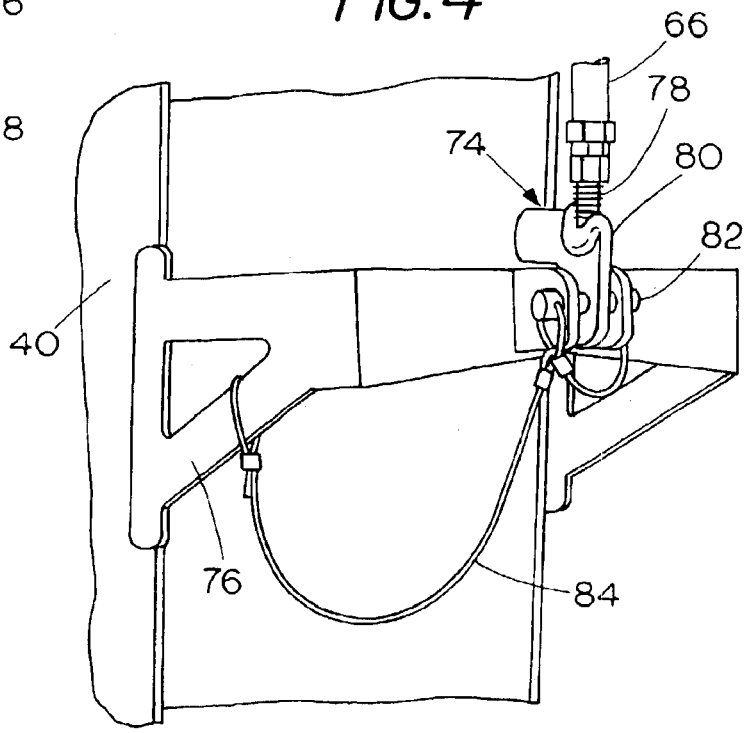
FIG. 4 is a perspective view of an attachment bracket for holding a support strut in position, and showing the adjustability of the support strut.

The springs 54 at the pivot 50 as shown in FIGS. 1 and 3, will exert a force to tend to hold the upper chute section 42 in its working or elected position, so after the strut 66 has been used to manually raise the upper chute section, it can be pinned in place for use as shown in FIGS. 1, 3 and 4. When the upper chute section 42 is moved to its storage position, the springs 54 go over center relative to the axis of pivot 50 as shown in FIG. 2. This over center movement provides a spring force that will urge the saddle 90 against the front edge ridge 24 of the snow blower housing 18 so that the saddle 90 will stay in its supporting position during storage.

The snow blower 10 then can be released or removed from the skid steer loader on which it is mounted, and the chute section 42 can be left its storage position.

The discharge chute 34 thus has a high discharge end in its working position so that it can discharge directly into large trucks, when snow is being removed from streets or parking lots. The upper chute section 42 will fold down so the overall attachment is of a reasonable height when it is in storage. It can be seen that the height is not substantially greater than the cab of the skid steer loader 12 when the discharge chute is in its folded position.

The snow blower attachment 10 will be capable of being moved through standard doors without a problem.

The housing 18 acts as a collector for the snow, and the auger 26 will move the snow that is being collected to an opening and into the impeller 30. The discharge chute 34 is directly on the impeller housing 32. The impeller 30 is a rotating element that projects the snow upwardly through the discharge chute 34.

Any type of feed auger or snow collector can be utilized, but an impeller or conveyor that projects the snow upwardly is used for blowing the snow upwardly through the high discharge chute during use.

Although the present invention has been described with reference to preferred embodiments, workers skilled in the art will recognize that changes may be made in form and detail without departing from the spirit and scope of the invention.

What is claimed is:

1. An apparatus for removing snow comprising a housing for collecting snow to be removed, a powered impeller for receiving snow from a front opening of the housing and projecting the snow upwardly, a discharge chute at a rear of the housing for receiving the snow from the impeller and providing a passage for the snow to an outer end of the discharge chute, said discharge chute having a base section mounted adjacent the impeller, and an upper chute section pivotally mounted to an upper end of the base chute section about a generally horizontal pivot at a forward side of the base chute section, the base chute section upper end being spaced above the housing, said upper chute section forming an extension of the base chute section in a working position, and being foldable downwardly about the pivot, an outer end of the upper chute section when folded downwardly being below an upper edge of the housing, a support saddle on the upper chute section that engages an upper edge portion of the housing when the upper chute section is in a downwardly folded position for storage, and a spring for providing a force urging the upper chute section to seat on the base chute section when in the working position, and said spring being attached between the base chute section and the upper chute section such that the line of force of the spring goes over center relative to the horizontal pivot as the upper chute section folds to the downwardly folded position for storage whereby the spring then exerts a force urging an outer end of the upper chute section toward the upper edge portion of the housing.

2. An apparatus for removing snow comprising a housing for collecting snow to be removed, a powered impeller for receiving snow from a front opening of the housing and projecting the snow upwardly, a discharge chute at a rear of the housing for receiving the snow from the impeller and providing a passage for the snow to an outer end of the chute, said discharge chute having a base section mounted adjacent the impeller, and an upper chute section pivotally mounted to an upper end of the base chute section about a generally horizontal pivot at a forward side of the base chute section, the base chute section upper end being spaced above the housing, said upper chute section forming an extension of the base chute section in a working position, and being foldable downwardly about the pivot with an outer end of the upper chute section when folded downwardly being below an upper edge of the housing, a movable strut having one end pivotally mounted to the upper chute section, a support saddle mounted on the movable strut at a position spaced from the one end, the support saddle engaging an upper edge portion of the housing to support the movable strut and the upper chute section when the upper chute section is in a downwardly folded position, and, and a bracket on said base chute section, said second end of said strut being attachable to the bracket on the base chute section with the upper chute section in its working position.

3. A powered snow blower having a forward facing inlet, a discharge chute for receiving snow projected by the snow blower, and directing the snow to a discharge end, the discharge chute having a base chute section mounted on a rear portion of the snow blower, and an upper chute section having the discharge end and being pivotally mounted to an upper end of the base chute section about a generally horizontal pivot at a forward side of the discharge chute, the upper chute section being foldable forwardly to overlie the forward facing inlet so the discharge end extends downwardly and is adjacent a support surface for the snow blower, and is supported on an upper forward edge portion of the snow blower.

4. The snow blower of claim 3, and a strut pivotally mounted to the upper chute section, and the strut having an end supportable on the base chute section when the upper chute section is in a working position to hold the upper chute section in the working position.

5. A powered snow blower having a discharge chute for receiving snow projected by the blower, and directing the snow to a discharge end, the discharge chute having a base chute section mounted on the snow blower, and an upper chute section having the discharge end and being pivotally mounted to an upper end of the base chute section about a generally horizontal pivot, the upper chute section being foldable forwardly so the discharge end is adjacent a support surface for the snow blower, and is supported on a portion of a housing of the snow blower, and a spring for providing a force urging the upper chute section to seat on the base chute section when in a working position, and said spring being attached between the base chute section and the upper chute section such that a line of force of the spring goes over center relative to the horizontal pivot when the upper chute section is folded with the discharge end adjacent the support surface.

6. A snow blower of attachment for a prime mover comprising a housing having a snow feeder, a powered impeller for receiving snow from the snow feeder and projecting the snow upwardly, a discharge chute for receiving snow from the impeller for discharging snow at a raised position, the discharge chute including a base chute section, and an upper chute section pivotally mounted together about a generally horizontal pivot, said upper chute section forming an extension of the base chute section in a working position and the upper chute section being foldable downwardly about the pivot to overlie a portion of the housing, a support bracket on the upper chute section that engages and is supported on a portion of the housing when the upper chute section is in downwardly folded position for storage, and a spring for providing a force urging the upper chute section to seat on the base chute section when in the working position, and the spring being mounted to urge the upper chute section toward the housing when the upper chute section is folded downwardly.

7. A snow blower attachment for a prime mover comprising a housing having a snow feeder, a powered impeller for receiving snow from the snow feeder and projecting the snow upwardly, a discharge chute for receiving snow from the impeller for discharging snow at a raised position, the discharge chute including a base chute section and an upper chute section pivotally mounted together about a generally horizontal pivot, said upper chute section forming an extension of the base chute section in a working position and the upper chute section being foldable downwardly about the pivot to overlie a portion of the housing, a support bracket on the upper chute section that engages and is supported on a portion of the housing when the upper chute section is in downwardly folded position for storage, said support comprising a strut that has one end pivotally mounted to the upper chute section, said strut having a second end connectable to the base chute section to support the upper chute section in a working position, the strut extending from the pivot of the one end to an attachment on the base chute section below the pivotal mounting between the base chute section and upper chute section, and when the upper chute section is folded downwardly, the strut extending from the pivot of the one end to the rest of the housing, said strut second end having a bracket that is adjustable along an axis of the strut, said bracket being releasably attachable to the base chute section with the upper chute section in its working position.

* * * * *

UNITED STATES PATENT AND TRADEMARK OFFICE

CERTIFICATE OF CORRECTION

PATENT NO. : 6,931,771 B1
DATED : August 23, 2005
INVENTOR(S) : Liebl

It is certified that error appears in the above-identified patent and that said Letters Patent is hereby corrected as shown below:

Column 4,
Line 46, after “base” insert -- chute --.

Column 5,
Line 7, after “base” insert -- chute --.
Line 22, delete “and,” first instance.
Line 23, “said second end” should be -- a second end --.

Column 6,
Line 39, after “support” insert -- bracket --.
Line 48, “the rest of” should be -- rest on --.

Signed and Sealed this

Twenty-fourth Day of January, 2006

JON W. DUDAS
*Director of the United States Patent and Trademark Office*